US005145060A

United States Patent [19]

Maye

[11] Patent Number: 5,145,060

[45] Date of Patent: Sep. 8, 1992

[54] PRE-PACKED MODULAR DISPLAY UNIT

[76] Inventor: Robert Maye, 6414 Lake Worth Rd., Lake Worth, Fla.

[21] Appl. No.: 767,235

[22] Filed: Sep. 27, 1991

[51] Int. Cl.[5] ..... B65D 21/02

[52] U.S. Cl. ..... 206/45.14; 206/44 R; 206/446

[58] Field of Search ..... 206/44 R, 45.11, 45.14, 206/45.19, 45.33, 446, 497, 521, 586, 589, 590, 591, 597, 821

[56] References Cited

U.S. PATENT DOCUMENTS 2,534,010 12/1950 Frye ..... 206/597
2,534,011 12/1950 Frye ..... 206/597
3,348,673 10/1967 Bahls et al. ..... 206/597
4,567,981 2/1986 Headon ..... 206/45.19
4,913,290 4/1990 de Groot ..... 206/597

FOREIGN PATENT DOCUMENTS 106898 7/1967 Denmark ..... 206/44 R

*Primary Examiner*—Jimmy G. Foster
*Attorney, Agent, or Firm*—Kane, Dalsimer, Sullivan, Kurucz, Levy, Eisele and Richard

[57] ABSTRACT

An environment favoring vertical display assembly for merchandising containerized articles sandwiches a plurality of block of the containers between an upper and a lower tray. The trays are constructed to receive the top portion of one block and the bottom portion of an adjacent block. Means are provided for preventing lateral movement of the block of containers between the trays, the means being free of fixed attachment to the trays.

7 Claims, 7 Drawing Sheets

PRE-PACKED MODULAR DISPLAY UNIT

BACKGROUND OF THE INVENTION

FIELD OF THE INVENTION

The invention relates to modular shelf displays of pre-stocked articles for merchandising.

SUMMARY OF THE INVENTION

The invention comprises a ready-to-assemble, modular, pre-shelf stocked vertical merchandise display, which comprises;

a plurality of pre-shelf stocked units adapted by size and configuration to be stacked together in a vertical array, each unit comprising;

(a) an upper tray having a top planar surface, a bottom planar surface and a peripheral edge defining the outer boundary of the tray;

(b) a first flange integrally connected to the peripheral edge of the upper tray and extending perpendicular to the top and bottom planar surfaces a pre-determined distance above the plane of the top planar surface and a pre-determined distance below the plane of the bottom planer surface, (c) a lower tray positioned parallel to but spaced apart from the upper tray, said lower tray having a top planar surface, a bottom planar surface and a peripheral edge defining the outer boundary of the lower tray;

(d) a second flange integrally connected to the peripheral edge of the lower tray and extending perpendicular to the top and bottom planar surfaces of the lower tray a pre-determined distance above the plane of the lower tray, top planar surface and a pre-determined distance below the plane of the lower tray bottom planar surface, said second flange enclosing the peripheral edge of the lower tray;

(e) a plurality of container packaged articles for display substantially filling the space between the parallel upper and the lower trays and bounded by the respective first and second flanges; and (f) removable means for stabilizing the plurality of container packaged articles against movement in a direction parallel to the top and bottom planar surfaces of the upper and lower trays, said means being removably located within the space defined by the upper tray, the lower tray, the first flange and the second flange, said means being free of a fixed attachment to the upper and lower trays.

DETAILED DESCRIPTION OF THE PREFERRED EMBODIMENTS OF THE INVENTION

Those skilled in the art will gain an appreciation of the invention from the following description of preferred embodiments when viewed together with the attached drawings of FIGS. 1–14, inclusive.

Figure 1:
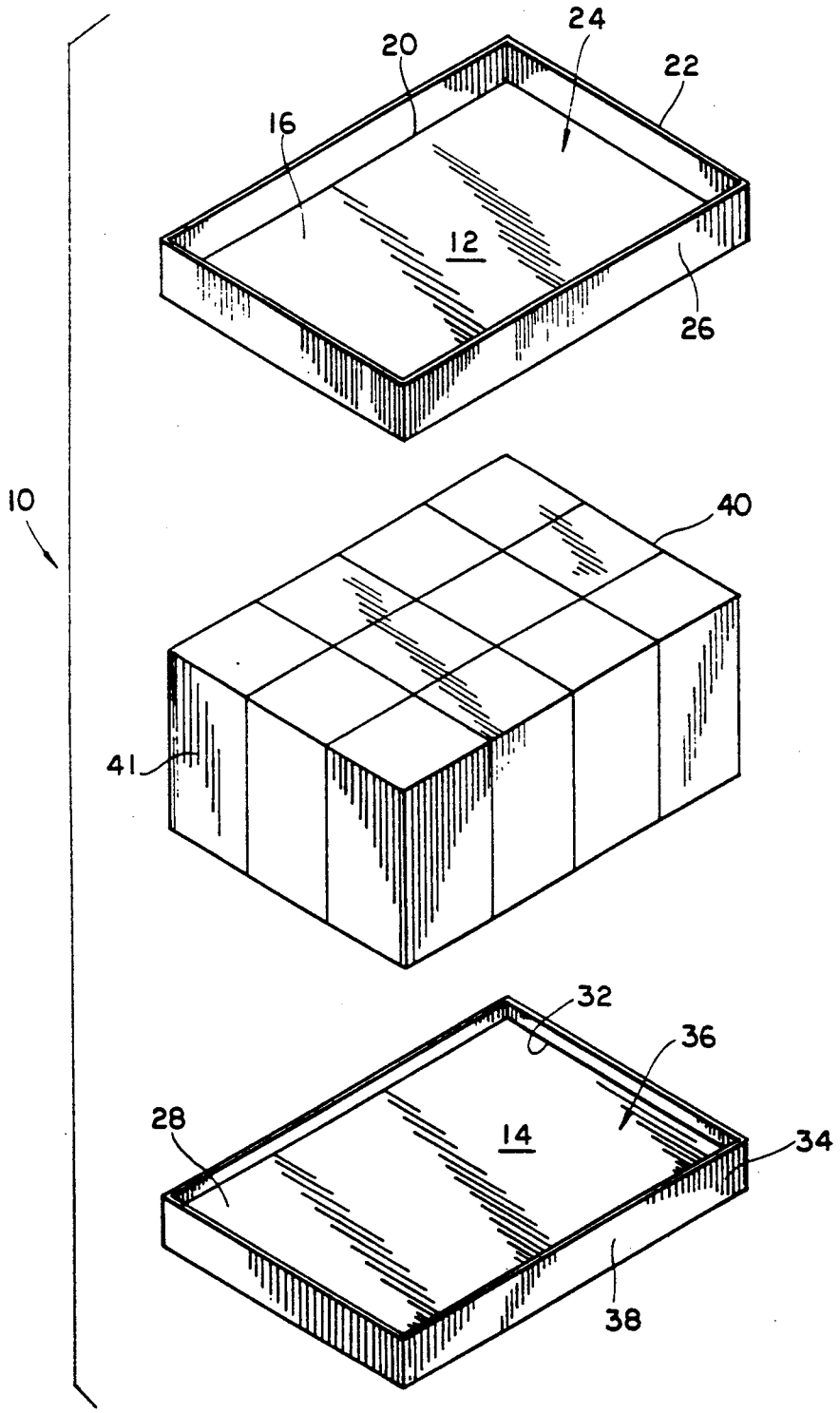
FIG. 1 is a view-in-perspective, exploded away, of an embodiment display component unit of the invention, without the horizontal support means component.

Referring first to FIG. 1, there is seen a preferred embodiment display component unit 10 of the invention shown in an exploded view and without the stabilizer means component. The component unit 10 comprises an upper tray 12 and a spaced apart, parallel lower tray 14. The upper tray 12 has a top planar surface 16 and a bottom planar surface 18 (not seen in FIG. 1; see FIG. 3). A peripheral edge 20 defines the outer boundary of the rectangular tray 12. Integrally joined to and part of the peripheral edge 20 along its entirety is a flange 22. Flange 22 extends perpendicular to the tray 12 planes of planar surfaces 16, 18 and extends a pre-determined distance above the plane of top planar surface 16 and a pre-determined distance below the plane of the bottom planar surface 18. Flange 22 circumscribes and encloses the peripheral edge 20 of tray 12 creating a recess 24 above top planar surface 16 and a recess 26 (not seen in FIG. 1) beneath the bottom planar surface 18; see FIG. 3 for further detail of this construction. Lower tray 14 is constructed in a manner identical to that of the upper tray 12. In other words, tray 14 consists of an upper planar surface 28, a lower planar surface 30 (not seen in FIG. 1; see FIG. 3) and a peripheral edge 32. Integrally attached to and part of peripheral edge 32 is a flange 34 which extends perpendicular to the tray 14 a pre-determined distance above the plane of top planar surface 28 and a pre-determined distance below the plane of bottom planar surface 30; see FIG. 3. The flange 34 in cooperation with tray 14 creates a recess 36 above top planar surface 28 and a recess 38 below bottom planar surface 30. The trays 12, 14 and the integral flanges 22, 34 are advantageously constructed from a lamination of two facing sheets of Kraft paper, sandwiching a layer of corrugated paper or a honeycomb core of paper or metal. Preferably, the honeycomb is a paper honeycomb to provide a very lightweight but structurally strong tray 12, 14 with recyclable components. Honeycomb core elements for fabricating laminate trays are very well known and available in the commercial market. Paper honeycomb materials may be fabricated by methods well known in the art; see for example the U.S. Pat. Nos. 3,518,151; 3,519,510; and 3,713,954; all of which are hereby incorporated herein by reference thereto. Methods of adhering honeycomb materials to Kraft paper facing sheets are also well known; see for example U.S. Pat. No. 2,815,795 which is incorporated herein by reference thereto. Also metal honeycomb foils referred to in the latter patent may be employed as structural elements for the trays 12, 14 described above when great bending strengths are required. However, an all paper construction is most preferred. Metal honeycomb materials and their use sandwiched between facing Kraft paper sheets are well known and commercially available from the Hexcel Corporation, Dublin, Calif. As is well known in the art, very high compressive strengths are associated with honeycomb sandwich structures, as are high bending strengths.

Trays 12, 14 are assembled together in a product shipper's factory by sandwiching between spaced apart, parallel trays 12, 14 a block of containerized articles 40. As shown in FIG. 1, the plurality of containerized articles 41 are loosely associated together to form the loose block 40. In this way, the upper portion of the block 40 of articles is nested within recess 26 and the lower portion of block 40 is nested within recess 36. A plurality of the component units 10 may be assembled together in the shipper's factory in a similar manner, so as to obtain a vertical array of one or more of the component units 10. Of course, adjacent blocks 40 in a vertical array of stacked units 10 can share one of the trays 12, 14 between them. For purposes of shipping, the component units 10 may be strapped separately or together in a vertical array. The straps, not shown in FIG. 1, may be removed at the destination of the prepackaged, shelf stocked display units for use at a point of purchase within a merchandizing environment. The uppermost of the trays 12 can then be removed for access to the upper block 40.

Figure 2:
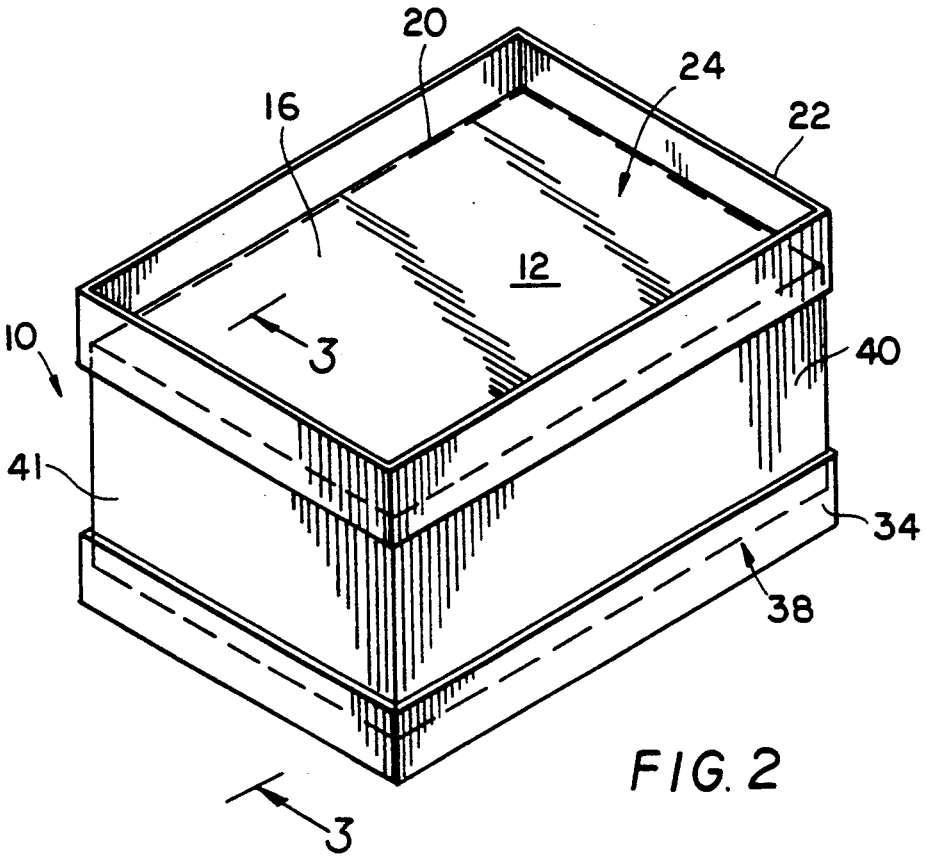
FIG. 2 is a view of the unit shown in FIG. 1, but assembled.

FIG. 2 is a view of the component unit 10 shown in FIG. 1, but assembled for shipment.

Figure 3:
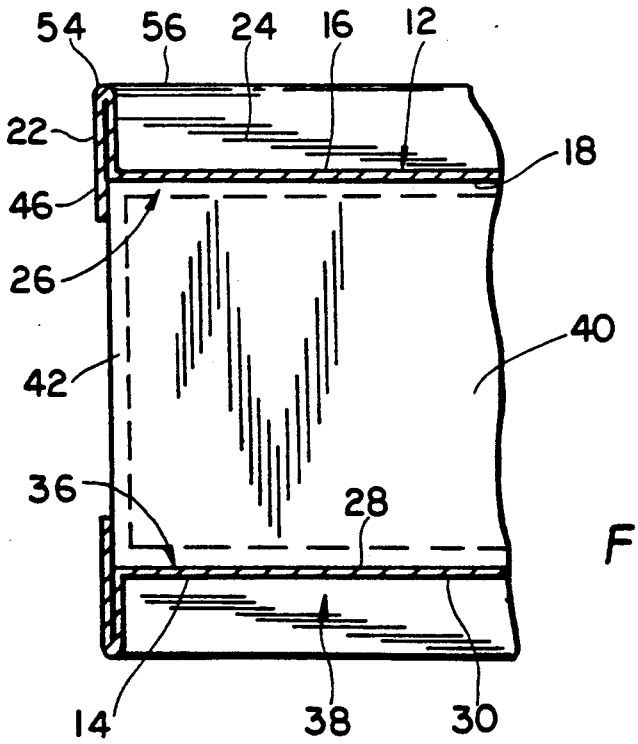
FIG. 3 is a view along lines 3—3 of FIG. 2.

FIG. 3 is a view along lines 3—3 of FIG. 2 and shows further detail of the component unit 10 ready for shipment or array with similar units 10 in a vertical display. FIG. 3 also shows that there is some small space 42 remaining after block 40 is received within the recesses 24 and 38 of respective trays 12, 14. Space 42 is deliberately planned for, so that the individual prepackaged cartons 41 of articles within block 40 may be removed without difficulty from their association with the remaining packaged articles, at the point of purchase when a consumer desires to remove one of the cartons. Generally, there is nothing which would bind the individual cartons 41 together other than frictional engagement with the trays 12, 14 in the assembled display unit 10. This frictional engagement is, of course, at the upper and lower ends of the cartoned block 40 only. Of course, when the upper tray 12 is removed to provide access to block 40 at the point of purchase, frictional engagement therewith is lost. The vertical array of units 10 provides in itself strong support in the vertical direction, and the trays need not be relied upon as the sole vertical direction support. However, there is nothing which would prevent the shift of the containerized articles of block 40 in a lateral direction, i.e., along a plane parallel to the body of trays 12, 14. This lack of structural integrity is accounted for by means described below.

Figure 4:
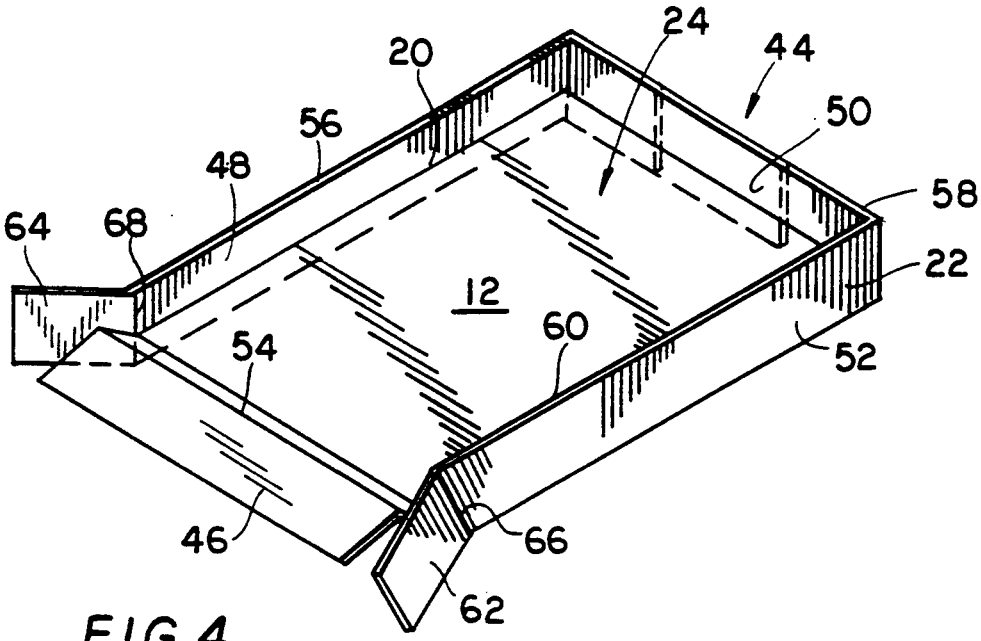
FIG. 4 is a view of an embodiment tray component as seen in FIGS. 1–3, assembled by folding from a unitary blank or sheet of Kraft paperboard.

Referring now to FIG. 4, a blank of Kraft linerboard is shown, partially assembled, to prepare a preferred form of the trays 12 or 14. For descriptive purposes, the upper tray 12 is shown in FIG. 4.

As shown in FIG. 4, the blank 44 is a single, integral sheet of Kraft linerboard having flap extensions 46, 48, 50 and 52 extending beyond the peripheral edge 20. Peripheral edge 20 is a first fold line for folding the extensions 46, 48, 50 and 52 upward, thereby forming the upper recess 24. A second fold line 54, 56, 58 and 60 on respective flap extensions 46, 48, 50 and 52 permits folding down of the outer portions of the flap extensions. The outer portions of the flap extensions 46, 48, 50 and 52 are longer than the inner portions of the flap extensions forming recess 24, i.e., inward of the respective fold lines 54, 56, 58, 60. In this way, the flap extensions 46, 48, 50, 52 project downwardly a pre-determined distance at a 90 degree angle to tray 12, thereby enclosing the lower recess 26 previously described The flap extensions 46, 48, 50 and 52 also project upwardly a pre-determined distance at a 90° angle to tray 12 to enclose upper recess 24. Flaps 64, 62 fold along respective fold lines 66, 68 to seal and with adhesive adhesively secure together the folded extensions 46, 48 and 52. Similar flap constructions are at the opposite end of tray 12 to secure adhesively the flap extensions 48 and 52 with flap extension 50. In this way, a secure construction of the tray 12 (and tray 14) is achieved. Further details of the flap extensions may be seen by referring to FIG. 3.

Figure 5:
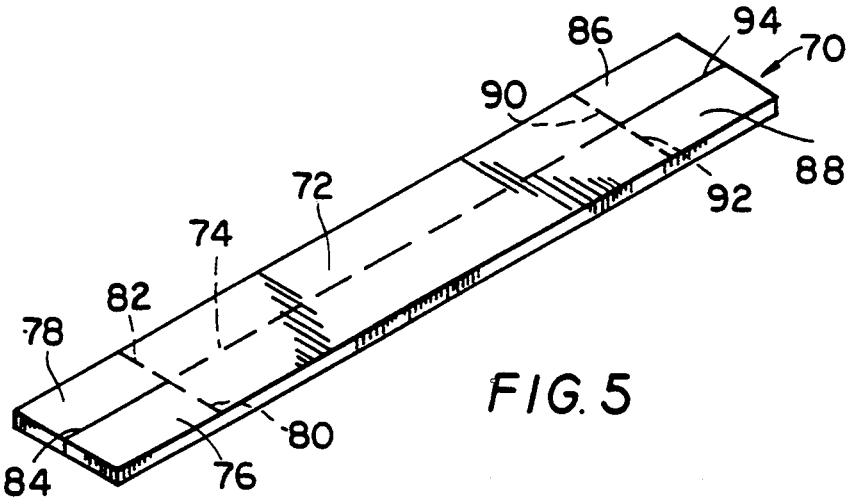
FIG. 5 is a view of an unassembled divider, used as a stabilizing means component of the unit shown in FIGS. 1–3, to provide lateral (horizontal) support.
Figure 6:
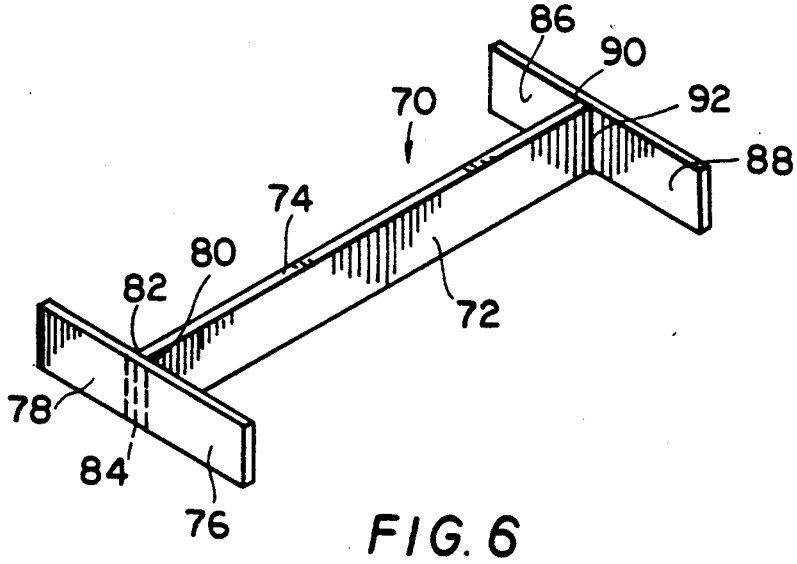
FIG. 6 is a view-in-perspective of the assembled divider shown in FIG. 5.

As mentioned above, the assembled component unit 10 must include means for preventing the lateral shift of containerized articles 41 within block 40. FIG. 5 is a view of an unassembled divider, used as a stabilizer means component of the unit 10 shown in FIGS. 1, 2, 3, to provide lateral (horizontal) support to the containerized articles 41 within block 40. The assembled divider 70 is shown in FIG. 6. A rectangular cellulosic sheet portion 72 is folded along its midline 74 to provide an upright divider 72 of double wall construction. Extensions 76 and 78, separated by a through cut 84 are folded along respective fold lines 80, 82 to provide a T-shape anchor as shown in FIG. 6. Similarly, on the opposing end extensions 86, 88 separated by through cut 94 are folded along respective fold lines 90, 92 to provide an opposing T-shape anchor as shown in FIG. 6. The divider 70, or a plurality of dividers 70 may be inserted as required between rows of the containerized articles 41 making up block 40 at the base or summit of the block 40, to provide resistance to lateral movement in a plane parallel to the overall plane of trays 12, 14. The T-shaped anchor ends of the dividers 70 may make frictional engagement with the flanges 22 or 34 in space 42 (see FIG. 3).

Figure 8:
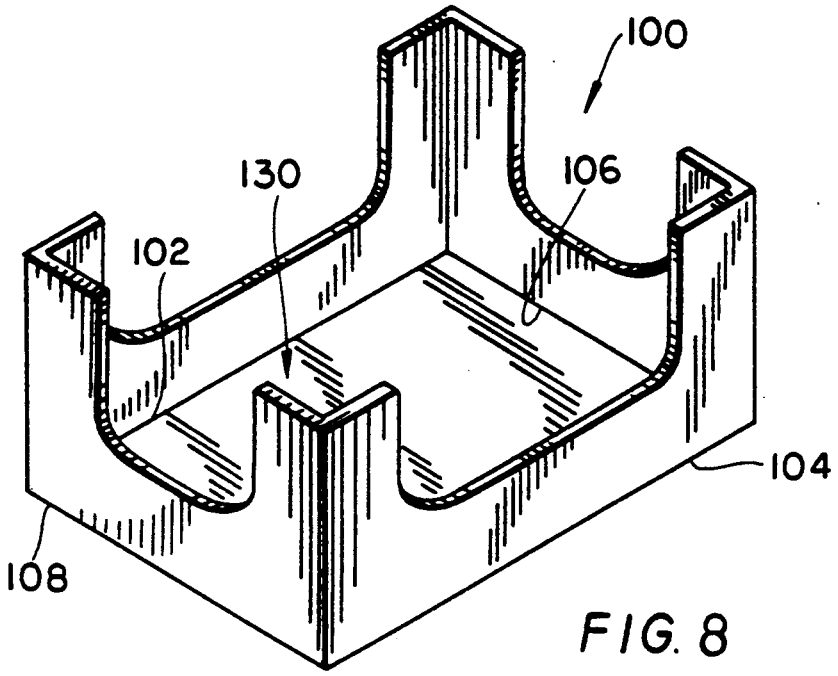
FIG. 8 is a view-in-perspective of the assembled support means shown in FIG. 7.
Figure 7:
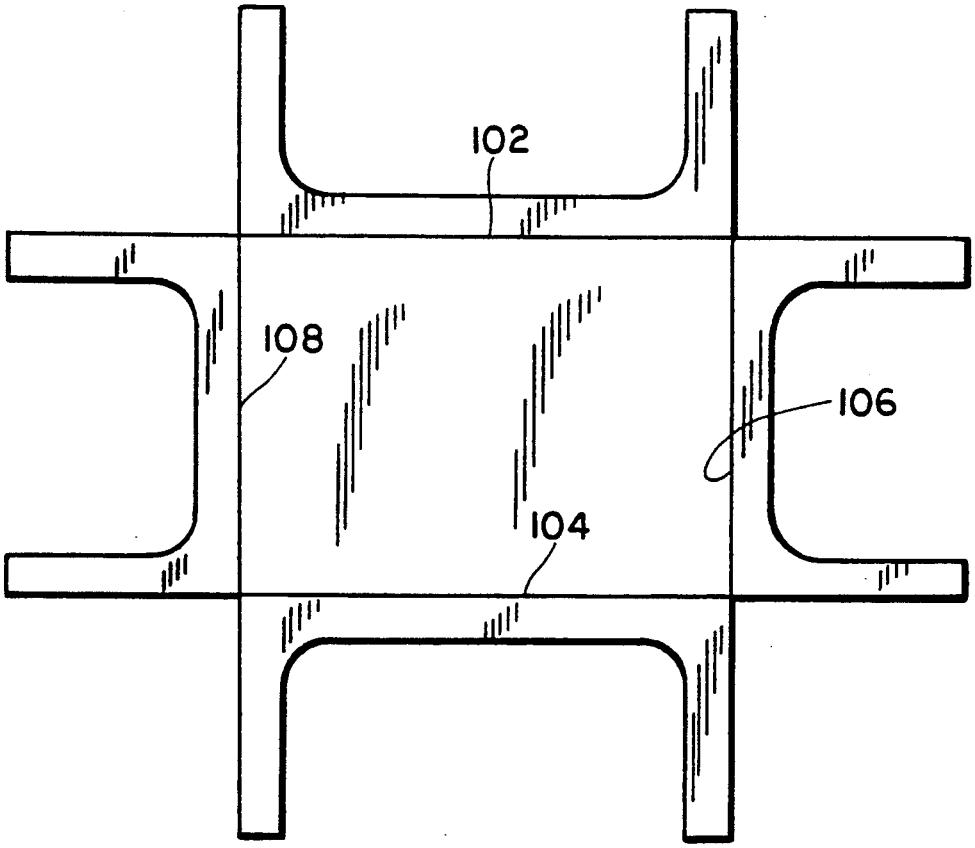
FIG. 7 is a view of another embodiment stabilizing means component of the unit shown in FIGS. 1–3, to provide lateral (horizontal) support (unassembled).

FIG. 7 is a view of another embodiment stabilizer means component of the unit 10 shown in FIGS. 1-3, for providing lateral (horizontal) support (unassembled). The assembled embodiment means is shown in FIG. 8, a view-in-perspective. The embodiment means 100 may be fabricated from a single, unitary sheet of Kraft linerboard cut to the configuration shown in FIG. 7, by folding upwardly along the respective fold lines 102, 104, 106, 108. When thus assembled, the means component 100 has the configuration shown in FIG. 8. This unit can receive within the enclosed chamber 130 the block 40 of containerized articles 41 for merchandizing and shipping. When held between the upper tray 12 and lower tray 14 in space 42 as previously described, lateral support is provided to the block 40 so that the containerized articles 41 cannot shift in position during shipping or while at the point of purchase in its display function, thereby unstabilizing a vertical array. The means 100 rests in the recess 24 or 38 without a fixed attachment to the trays 12, 14.

Figure 9:
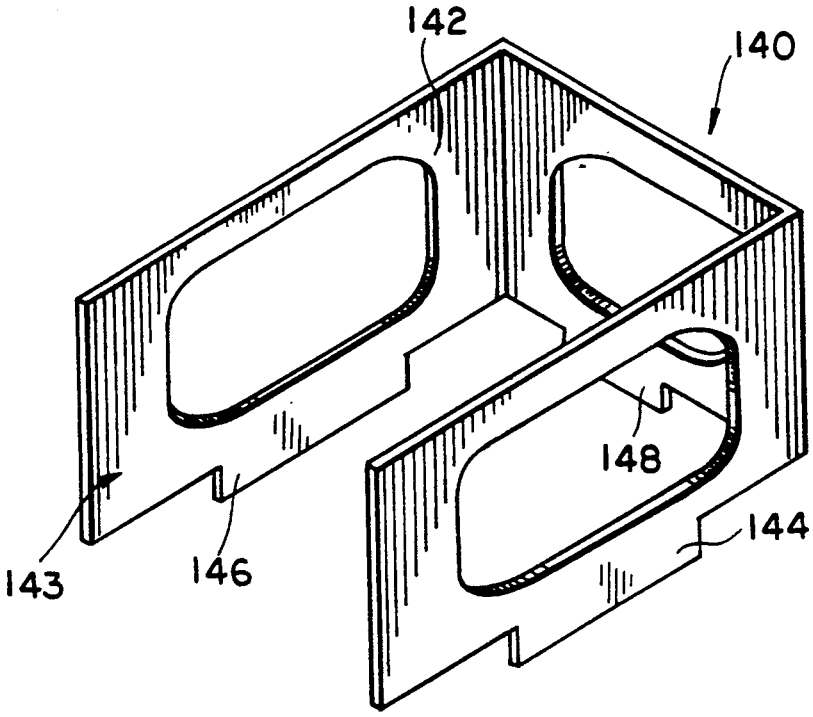
FIG. 9 is a view-in-perspective of still another stabilizing means for horizontal support of the unit shown in FIGS. 1–3, (assembled).

FIG. 9 is a view-in-perspective of still another stabilizer means for horizontal support to the block 40 of prepackaged articles 41 for display in the component unit 10 shown in FIGS. 1-3, fabricated from a single sheet of Kraft linerboard. Thus, sheet 142 is folded and apertured as shown in FIG. 9, to enclose within its perimeter the block 40, with a single open end 143. Tabs 144, 146 and 148 may project downward for insertion within cuts provided in the lower tray 14 at appropriate locations to anchor the stabilizer means 140 for further lateral support.

Figure 10:
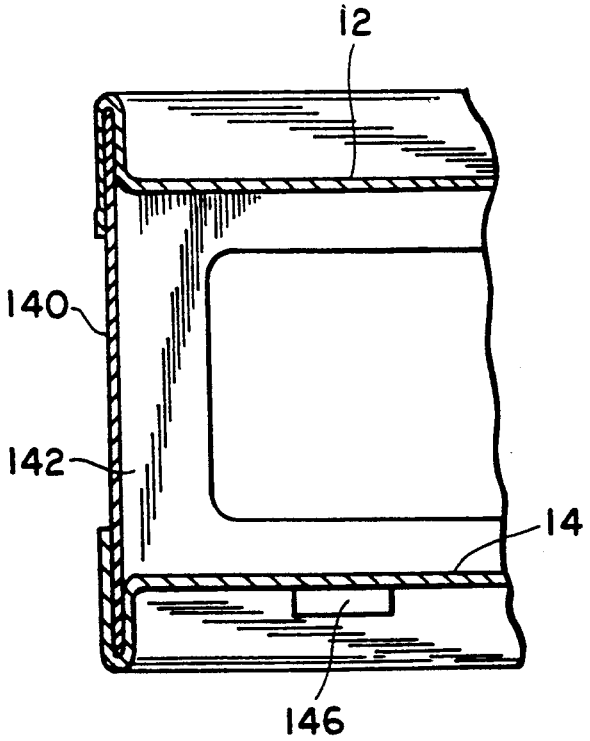
FIG. 10 is a fragmentary view of the unit of FIG. 3, in cross-section, shown in combination with the stabilizing means of FIG. 9.

FIG. 10 is a fragmentary view of the unit 10 of FIG. 3 in cross-section, shown in combination with the stabilizer means 140 of FIG. 9 to show structural details. This means 140 prevents loss of containerized articles 41 from block 40 by lateral movements during shipping and display.

The means 140 with partially enclosed block 40 nests in space 42 (see FIG. 3) between the trays 12, 14. There is no fixed attachment of means 140 to the trays 12, 14.

Figure 11:
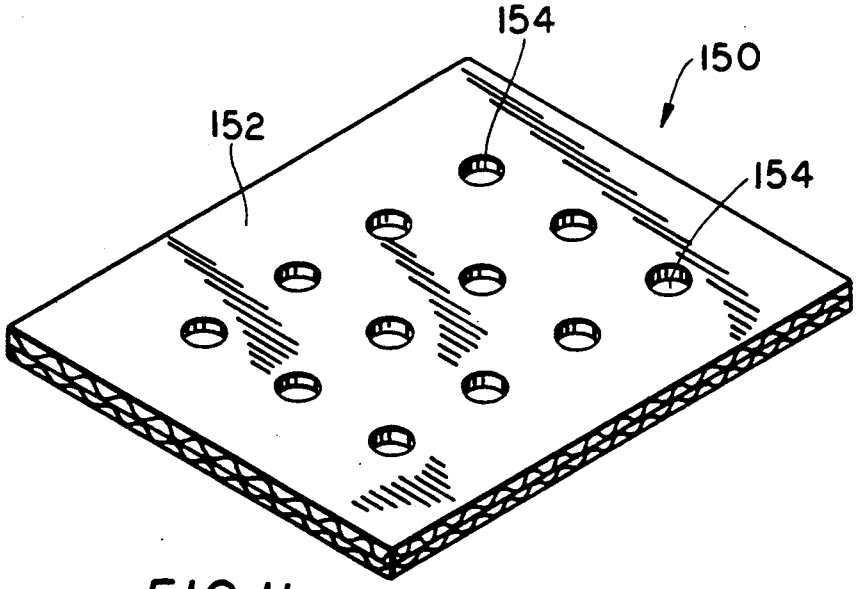
FIG. 11 is a view-in-perspective of another embodiment stabilizing means for lateral (horizontal) support component of the unit shown in FIGS. 1–3 and particularly adapted for use with necked containers used to package the articles for display.

FIG. 11 is a view-in-perspective of an embodiment stabilizer means for horizontal or lateral support of block 40 components for use in the unit shown in FIGS. 1-3 and particularly adapted for use with necked-containers 41 used to package the articles for display. Thus, means 150 comprises a planar sheet 152 of Kraft linerboard or like material, apertured appropriately with apertures 154 to receive the neck of a bottle type container. This receivership of the necked-containers, prevents lateral movement of the individual containers within block 40 of containers.

Figure 12:
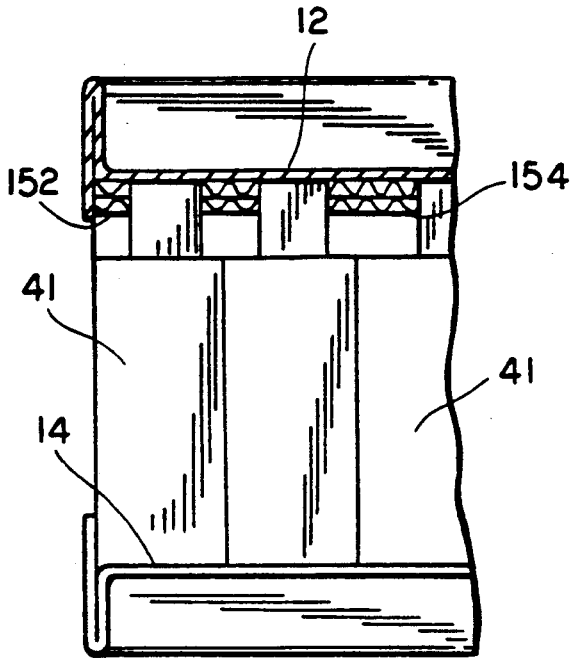
FIG. 12 is a fragmentary view of the unit of FIG. 3, in cross-section, shown in combination with the stabilizing means shown in FIG. 11 and in conjunction with display articles packaged in necked-containers.

FIG. 12 is a fragmentary view of the unit 10 of FIG. 3, in cross-section, shown in combination with a stabilizer means for horizontal support as shown in FIG. 11 and in conjunction with articles packaged in necked-containers 41. The means 150 is preferably not fixed by attachment to tray 12.

Figure 13:
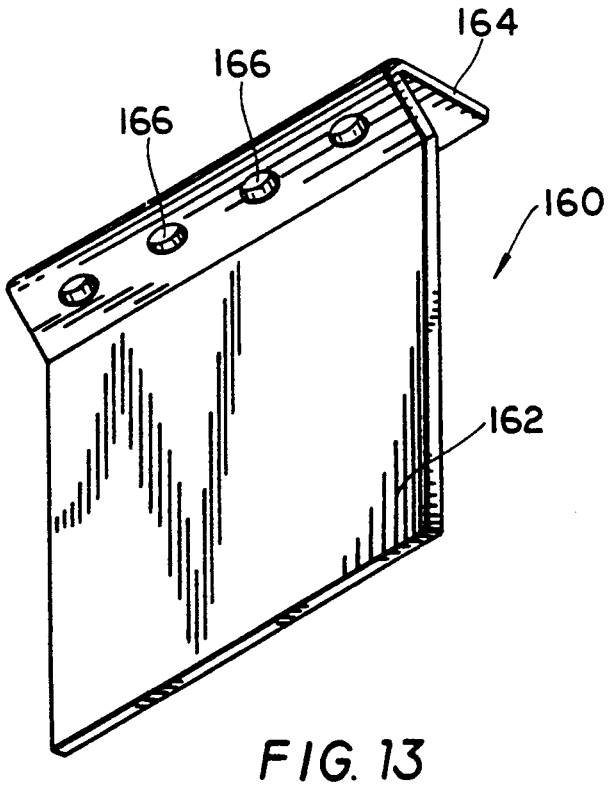
FIG. 13 is a view-in-perspective of a preferred embodiment stabilizing means for lateral (horizontal) support component of the unit shown in FIGS. 1–3 and particularly adapted for use with necked containers used to package the articles for display.

FIG. 13 is a view-in-perspective of a preferred embodiment stabilizer means for horizontal or lateral support of block 40 for use in the component unit 10 shown in FIGS. 1-3 and particularly adapted for use with necked containers 41 used to package articles for display and inclusion in block 40. Thus, means 160 consists of a single sheet of cellulosic material folded as in FIG. 13 to provide a vertical divider 162 and a horizontal support element 164 for association with the lower planar surface 18 of a tray 12. Apertures 166 in a fold of the divider 162 receive the neck of necked containers 41 used to package the aforementioned articles.

Figure 14:
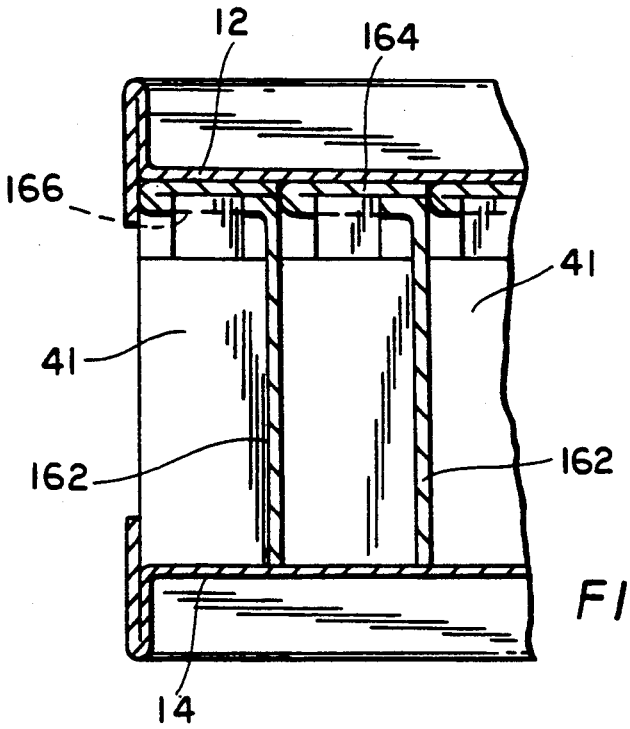
FIG. 14 is a fragmentary view of the unit of FIG. 3, in cross-section, shown in combination with the stabilizing means shown in FIG. 13 and in conjunction with articles packaged in necked-containers.

FIG. 14 is a fragmentary view of the assembled container unit 10 shown in FIGS. 1-3, but including the stabilizer means 160 shown in FIG. 13. This unit is particularly preferred since it not only secures a necked container 41 but, by its inclusion between rows of containers 41, provides the advantages of a divider between the contained articles 41 making up block 40.

Each of the embodiment units with a stabilizer means described above, may be assembled together in a vertical display of any number of component units 10. The vertical display will comprise blocks 40 of containerized 41 articles, alternating with a tray 12 or a tray 14. Upon initial set up, only the upper tray 12 need be removed (which is readily done since the stabilizer means is not fixedly attached to the trays 12, 14) for access to the block 40 and containers 41.

As each tray is removed, the underlying block 40 is made accessible. All of the components, including the stabilizer means are paper, readily recycled to protect the environment.

It will be appreciated by those skilled in the art that many modifications may be made to the above described preferred embodiments of the invention without departing from the spirit and the scope of the invention. For example, although cellulosic materials are preferred to fabricate the displays of the invention, non-cellulosics such as plastic or metal are useful.

In any event, it will also be appreciated by those skilled in the art that the display assembly may be put together or knocked down without a requirement for tools of any sort. also, since the trays 12, 14 and any additional tray components may be identical in construction, small inventories may be maintained and manufacturing is facilitated.

What is claimed is:

1. A ready-to-assemble, modular, pre-shelf stocked vertical merchandise display, which comprises; p1 a plurality of pre-shelf stocked units adapted by size and configuration to be stacked together in a vertical array, each unit comprising;

(a) an upper tray having a top planar surface, a bottom planar surface and a peripheral edge defining the outer boundary of the tray;

(b) a first flange integrally connected to the peripheral edge of the upper tray and extending perpendicular to the top and bottom planar surfaces a pre-determined distance, above the plane of the top planar surface and a pre-determined distance below the plane of the bottom planer surface, said first flange enclosing the peripheral edge of the upper tray;

(c) a lower tray positioned parallel to but spaced apart from the upper tray, said lower tray having a top planar surface, a bottom planar surface and a peripheral edge defining the outer boundary of the lower tray;

(d) a second flange integrally connected to the peripheral edge of the lower tray and extending perpendicular to the top and bottom planar surfaces of the lower tray a pre-determined distance above the plane of the lower tray, top planar surface and a pre-determined distance below the plane of the lower tray bottom planar surface, said second flange enclosing the peripheral edge of the lower tray;

(e) a plurality of container packaged articles for display substantially filling the space between the parallel upper and the lower trays and bounded by the respective first and second flanges; and (f) removable means for stabilizing the plurality of container packaged articles against movement in a direction parallel to the top and bottom planar surfaces of the upper and lower trays, said means being removably located within the space defined by the upper tray, the lower tray, the first flange and the second flange, said means being free of a fixed attachment to the upper and lower trays.

2. The display of claim 1 fabricated entirely from recyclable cellulosic materials.

3. The display of claim 1 wherein the means is a divider between rows of containerized articles.

4. The display of claim 1 wherein the means is an enclosure adjacent to and between the peripheral edge of the upper tray and the peripheral edge of the lower tray.

5. The display of claim 1 wherein the means is a planar sheet apertured to receive the neck of a necked-container.

6. The display of claim 1 wherein the means is a divider between rows of necked-containers, having a horizontal fold apertured to receive the necks of the necked-containers.

7. A merchandising display of containerized articles, which comprises;

a plurality of assemblies of the containerized articles, said assemblies forming blocks of loosely associated containerized articles, said blocks including means for stabilizing the block from lateral movement, inserted adjacent to individual containerized articles within the block, said assemblies being arrayed together in a vertical stock; and interposed between each adjacent assemblies a tray, comprising a top planar surface, a bottom planar surface and a peripheral edge defining the outer boundary of the tray; an a first flange integrally connected to the peripheral edge of an uppermost tray and extending perpendicular to the top and bottom planar surfaces a pre-determined distance above the plane of the top planar surface and a pre-determined distance below the plane of the bottom planar surface, said first flange enclosing the peripheral edge of the upper tray.

* * * * *